US009730533B2

(12) United States Patent
Cornelson

(10) Patent No.: US 9,730,533 B2
(45) Date of Patent: Aug. 15, 2017

(54) APPARATUS AND METHOD FOR DISPLAYING ITEMS

(71) Applicant: Billy Ray Cornelson, Mobile, AL (US)

(72) Inventor: Billy Ray Cornelson, Mobile, AL (US)

(73) Assignee: ELIZABETH ANN'S, LLC, Mobile, AL (US)

( * ) Notice: Subject to any disclaimer, the term of this patent is extended or adjusted under 35 U.S.C. 154(b) by 0 days.

(21) Appl. No.: 14/621,276

(22) Filed: Feb. 12, 2015

(65) Prior Publication Data

US 2016/0235223 A1 Aug. 18, 2016

(51) Int. Cl.
*A47G 1/00* (2006.01)
*A47G 1/06* (2006.01)

(52) U.S. Cl.
CPC .... *A47G 1/0638* (2013.01); *A47G 2001/0666* (2013.01)

(58) Field of Classification Search
CPC ..... A47G 1/18; A47G 1/06; A47G 1/0638; A47G 1/0644; A47G 2001/0677; A47G 2001/0666
See application file for complete search history.

(56) References Cited

U.S. PATENT DOCUMENTS 476,357 A * 6/1892 Augir ..... A47G 1/065 40/733
1,096,320 A * 5/1914 Schluete ..... A47B 23/042 248/452
1,340,711 A * 5/1920 Greenwald ..... A47G 1/22 248/489
3,023,005 A * 2/1962 Hochman ..... A63F 1/06 273/148 A
5,619,816 A * 4/1997 Ellison ..... A47G 1/141 40/738
2002/0129529 A1* 9/2002 Heiliger ..... A47G 1/0633 40/721
2004/0055930 A1* 3/2004 Hsieh ..... B65D 73/0042 206/288

FOREIGN PATENT DOCUMENTS

BE 1012353 A6 * 10/2000 ..... G09F 1/10
FR 2720290 A1 * 1/1995 ..... A63F 1/06
GB 215627 A * 5/1924 ..... A63F 1/06
JP 2008228906 A * 10/2008 ..... A47G 1/00

* cited by examiner

*Primary Examiner* — Cassandra Davis
(74) *Attorney, Agent, or Firm* — AdamsIP, LLC; J. Hunter Adams; Stephen Thompson

(57) ABSTRACT

A frame for displaying items such as photographs, drawings, paintings, or documents, as well as a method of displaying such items, is provided. A substantially flat panel has a plurality of holes extending through the panel. A line, such as a string or rope, extends through each of the holes alternately through the front side of the panel and through the back side of the panel. The line is pulled taut to substantially remove slack in the line so that the line runs along the front surface of the panel between pairs of holes. The line is configured to cover corners or edges of a display item, thereby holding the display item securely in place within the frame.

1 Claim, 6 Drawing Sheets

APPARATUS AND METHOD FOR DISPLAYING ITEMS

FIELD OF THE INVENTION

The present invention relates to an apparatus and method of displaying items such as photographs, drawings, paintings, or documents.

BACKGROUND

Many different types of picture frames or other devices used to display items such as photographs, drawings, paintings, or various types of documents are known in the art. However, known frames or other display devices have a variety of problems. For instance, in some frames used to display photographs, it is difficult to change out an existing photograph for a new one. This process often involves taking the frame apart, replacing the displayed photograph, and then putting the frame back together. Furthermore, it can sometimes be difficult to center the photograph within the frame.

Accordingly, a need exists in the art for an apparatus for displaying items such as photographs, drawings, paintings, or documents that is simple, easy to use, and allows a user to easily change the display item to a new item. Furthermore, a need exists in the art for a method of displaying items such as photographs, drawings, paintings, or documents that is simple and straightforward.

SUMMARY

A preferred embodiment of the invention is directed generally to a frame for displaying items such as photographs, drawings, paintings, or documents, as well as a method of displaying such items. The frame of the present invention is comprised of a substantially flat panel having a plurality of holes extending through the panel. In a preferred embodiment, the panel has eight holes arranged in four pairs with each hole of a pair being closer to one another than to the remaining holes. The frame further comprises a single continuous length of line that is inserted into each of the plurality of holes in alternating directions (e.g., into a first hole through the back side of the panel and then into the next hole through the front side of the panel, and so on) and pulled tightly so that any slack in the line is substantially removed. A display item is held on the front of the panel by the line, which is taut and runs along the front surface of the panel between holes in at least two locations, and preferably in four locations, each location corresponding to one corner of a generally rectangular display item. The taut line covers at least two of the corners of the display item, and preferably four corners, so that the item is securely held in place. This simple design has very few parts, thereby providing a frame that is simple to use and allows a user to easily change a display item to a new item, as well as having an aesthetically pleasing appearance.

Accordingly, an object of the present invention is to provide a frame for displaying items that is simple, easy to use, and allows a user to easily change the display item to a new item. Yet another object of the present invention is to provide a frame that is simple and inexpensive to manufacture. Furthermore, an object of the present invention is to provide a method of displaying items that is simple and straightforward.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Turning now to the drawings, FIGS. 1-6 illustrate preferred embodiments of the invention. A preferred embodiment of the invention is directed generally to a frame for displaying items such as photographs, drawings, paintings, or documents, as well as a method of displaying such items. The frame of the present invention is comprised of a panel having a plurality of holes extending through the panel and a single length of line extending continuously through each of the holes, as described in greater detail below.

Figure 1:
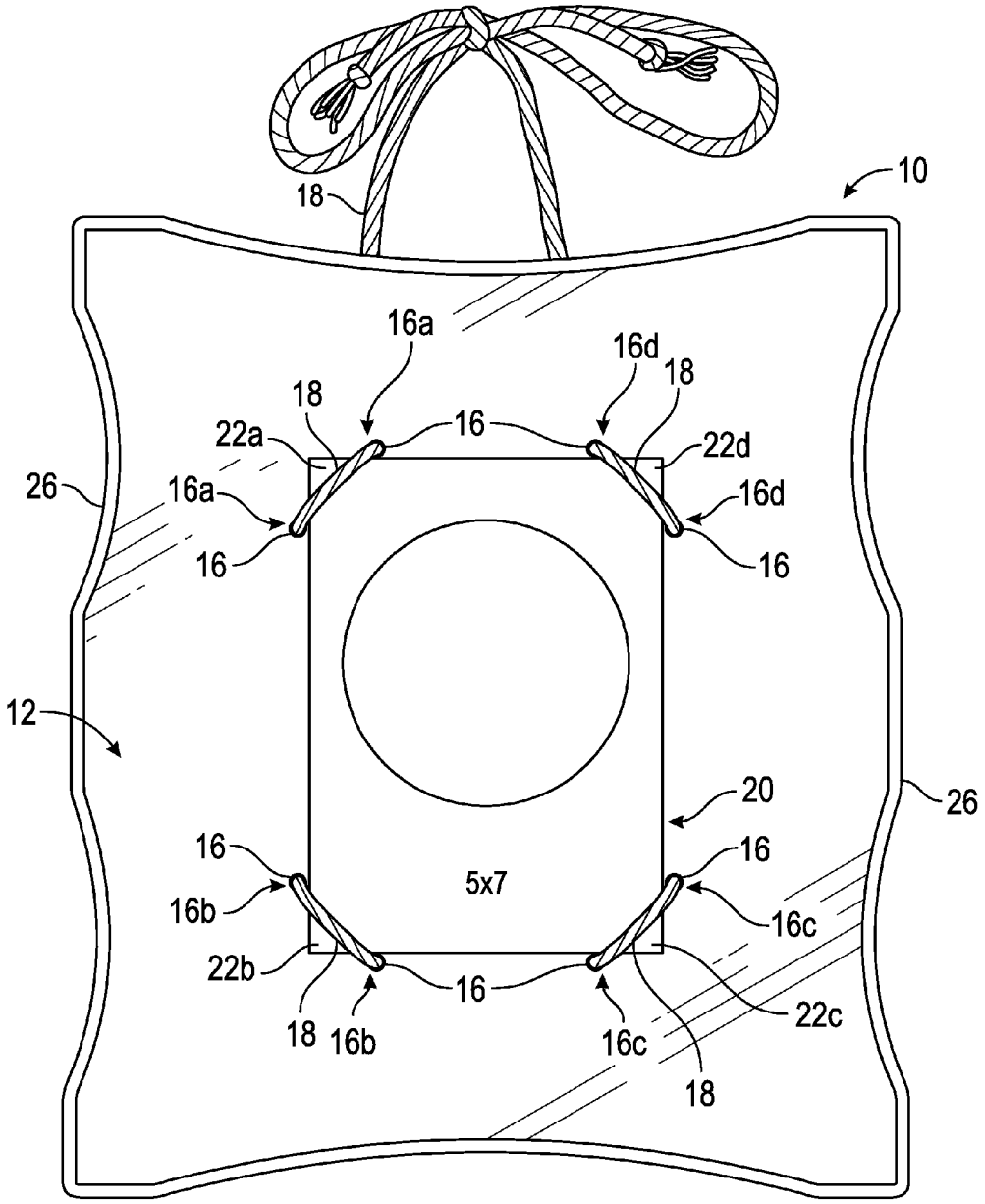
FIG. 1 is a front elevational view of an apparatus embodying features of the present invention.
Figure 3:
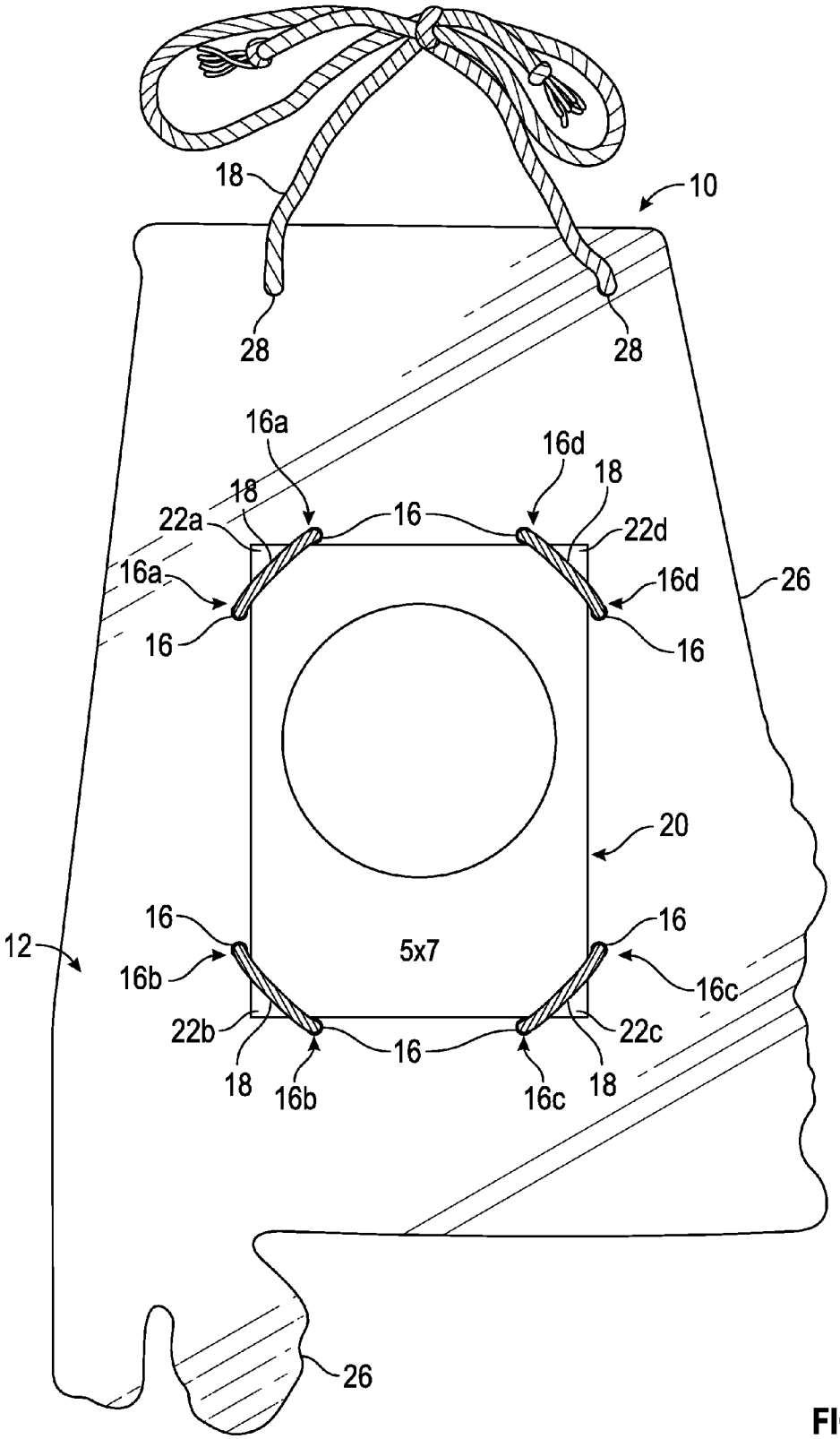
FIG. 3 is a front elevational view of an apparatus embodying features of the present invention.

The panel 10 is substantially flat and has a front side 12 and a back side 14. In a preferred embodiment, the panel 10 is comprised of wood. However, the panel 10 may also be comprised of cardboard, metal, plastic, glass, or any other suitable material. The panel 10 also has an outer perimeter 26, which may take any desired shape. In one embodiment, the panel 10 simply has a rectangular shape. However, in another embodiment as shown in FIG. 1, the panel 10 may have any irregular shape. In yet another embodiment as shown in FIG. 3, the panel 10 may take the shape of any state of the United States. In short, the shape of the outer perimeter 26 of the panel 10 is irrelevant to the present invention and may take any desired shape.

Figure 2:
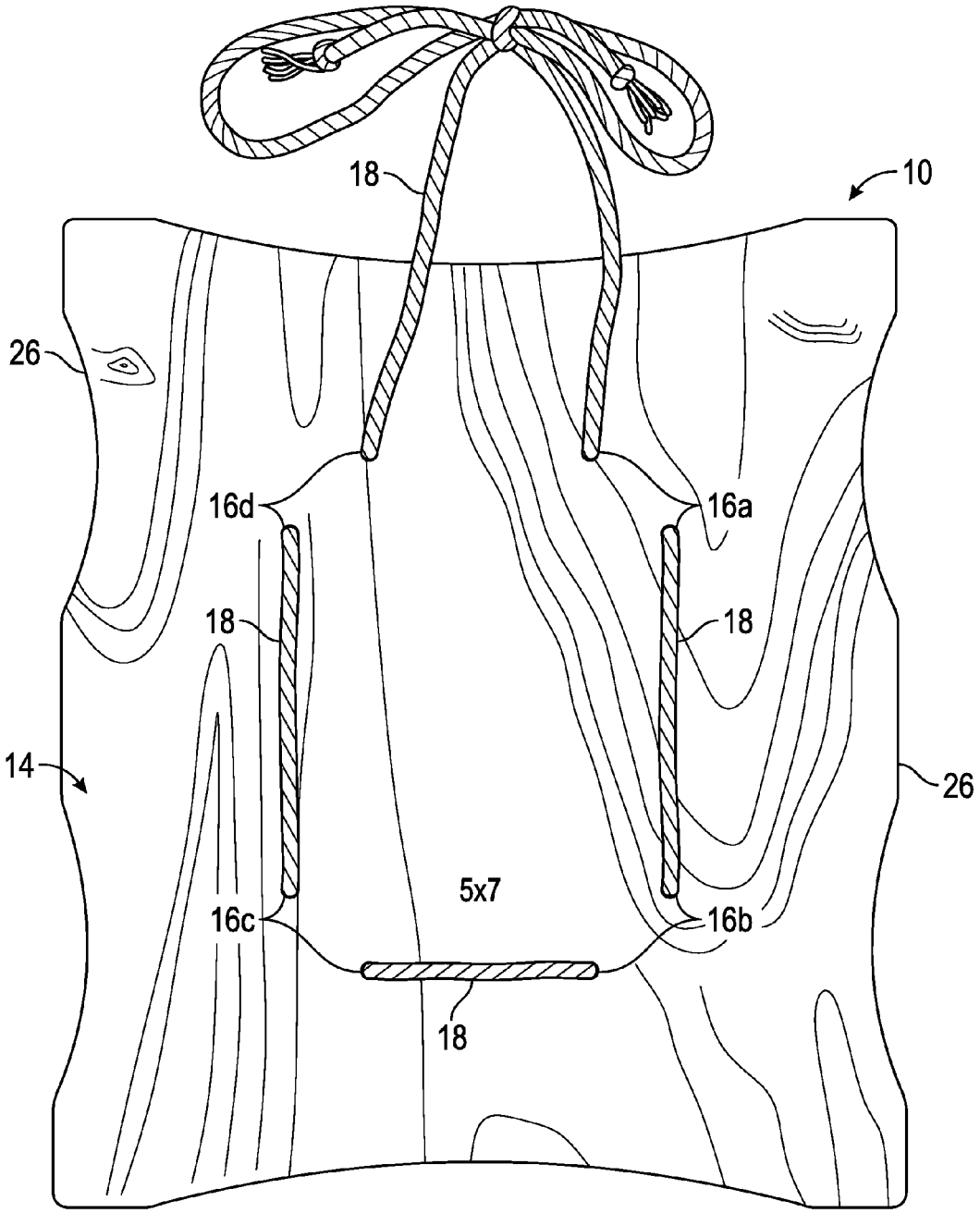
FIG. 2 is a rear elevational view of an apparatus embodying features of the present invention.

The frame of the present invention further comprises a plurality of holes 16 extending through the substantially flat panel 10. Although the panel 10 may have any number of holes 16, in a preferred embodiment as shown in FIGS. 1-2, the panel 10 has eight holes 16. In this preferred embodiment, the holes 16 are preferably arranged in four pairs 16*a*, 16*b*, 16*c*, 16*d*, with each hole of a pair being closer to the other hole of the pair than to the remaining holes. As shown in FIG. 1, each of the four pairs 16*a*, 16*b*, 16*c*, 16*d* corresponds to a corner 22*a*, 22*b*, 22*c*, 22*d* of a generally rectangular display item 20. Each pair 16*a*, 16*b*, 16*c*, 16*d* is arranged around each corresponding corner 22*a*, 22*b*, 22*c*, 22*d* such that a first hole of each pair 16*a*, 16*b*, 16*c*, 16*d* is positioned on one side of each corner 22*a*, 22*b*, 22*c*, 22*d* and a second hole of each pair 16*a*, 16*b*, 16*c*, 16*d* is positioned on the opposite side of the same corner 22*a*, 22*b*, 22*c*, 22*d*.

In a preferred embodiment, as illustrated in FIG. 1, a first pair 16*a* of holes is positioned generally in the upper left quadrant of the panel 10. Similarly, a second pair 16*b* of holes is positioned generally in the lower left quadrant of the panel 10. A third pair 16*c* is positioned generally in the lower right quadrant of the panel 10, and a fourth pair 16*d* is positioned generally in the upper right quadrant of the panel 10. When a generally rectangular display item 20 is positioned in its desired configuration in the frame, the first pair 16*a* of holes corresponds to the upper left corner 22*a* of the display item. Similarly, the second pair 16*b* corresponds to the lower left corner 22*b* of the display item 20. The third pair 16*c* corresponds to the lower right corner 22*c*, and the fourth pair 16*d* corresponds to the upper right corner 22*d*.

The frame of the present invention further comprises a single continuous length of line 18 having two ends. The line 18 may comprise a string, rope, wire, cord, belt, cable, strap, ribbon, or any similar elongated structure known in the art. The line 18 is inserted consecutively into each of the plurality of holes 16 in alternating directions (e.g., into a first hole 16 through the back side 14 of the panel 10 and then into the next hole through the front side 12 of the panel 10, and so on) until the line 18 extends through all desired holes 16. The line 18 is then pulled taut so that any slack in the line 18 is substantially removed. The two ends of the line 18 may then be used to attach the frame to a support structure in order to hang the frame. For instance, the two ends may be tied together, as shown in FIG. 1, to create a loop, which may then be hung from a hook attached to a wall, or attached to a similar type of support structure. Alternatively, each end of the line 18 may be separately attached to some type of support structure in order to hang the frame. As another alternative, the ends of the line 18 may be tied together tightly on the back side 14 of the panel 10, and the frame may be displayed without hanging or otherwise attaching the line 18 to a support structure.

Once the line 18 is pulled taut so that any slack in the line 18 is substantially removed, separate lengths of the line 18 extend along the surface of the front side 12 of the panel 10 between holes 16 in the panel 10 as shown in FIG. 1. Because the line 18 extends through each of the holes 16 without any significant amount of slack, the line 18 remains firmly in a stationary position. Thus, the line 18 can be used to hold a display item 20 firmly in place by covering the corners 22 of the display item 20.

As discussed above, the display item 20 may comprise a photograph, drawing, painting, document, or any similar visual representation a user wishes to display. However, in an alternative embodiment, the display item 20 may comprise a piece of transparent glass. In this embodiment, the piece of glass is held in place by the line 18 as described above. The photograph, drawing, painting, document, or other visual representation is then placed under the glass and held in place by the glass. This embodiment is particularly useful for displaying photographs, etc. of varying sizes using the same frame. In a preferred embodiment, the frame of the present invention further comprises the piece of transparent glass. The glass is sized to fit into a frame having holes 16 positioned in particular locations of the panel 10. Because a particular photograph, etc. that a user wishes to display may not fit precisely with the pre-formed holes 16 of a particular frame, the user can instead use the glass to hold the photograph provided that the photograph fits within the boundaries defined by the holes 16.

In a preferred embodiment, the holes 16 in the panel 10 are configured for use with a standard five inch by seven inch photograph. In the embodiments described herein, the photograph or other display item 20 utilized has a portrait configuration (the height is greater than the width). However, it should be understood by one skilled in the art that the configuration of the frame can be adjusted for use with a landscape configuration (the width is greater than the height) and still fall within the scope of the present invention. In alternative embodiments, the frame of the present invention may be available in different sizes defined by holes 16 in the panel 10 that are set further apart or closer together to accommodate photographs, drawings, paintings, documents, etc. of varying sizes. Each frame of a different size may be available with a piece of glass sized to fit the particular frame.

FIGS. 1-2 illustrate a preferred embodiment. In this embodiment, a photograph or other visual representation may be displayed through the following steps. First, one end of the line 18 is inserted through the back side 14 of the panel 10 into a first hole of the first pair 16*a* of holes corresponding to the upper left corner 22*a* of the display item 20. The first hole of the first pair 16*a* is preferably the uppermost and innermost of the first pair 16*a*, as illustrated in FIG. 2. The same end of the line 18 is then inserted through the front side 12 of the panel 10 into the second hole of the first pair 16*a* of holes, as illustrated in FIG. 1. Next, the line 18 is inserted through the back side 14 of the panel 10 into a first hole of the second pair 16*b* of holes corresponding to the lower left corner 22*b* of the display item 20. The end of the line 18 is then inserted through the front side 12 of the panel 10 into the second hole of the second pair 16*b*. The process continues in a similar manner by inserting the end of the line 18 through the back side 14 of the panel 10 into a first hole of the third pair 16*c* of holes corresponding to the lower right corner 22*c* of the display item 20. Next, the line 18 is inserted through the front side 12 of the panel 10 into the second hole of the third pair 16*c*. The end of the line 18 is then inserted through the back side 14 of the panel 10 into a first hole of the fourth pair 16*d* of holes corresponding to the upper right corner 22*d* of the display item 20. Finally, the line 18 is inserted through the front side 12 of the panel 10 into the second hole of the fourth pair 16*d*. As illustrated in FIGS. 1-2, the two ends of the line 18 may then be tied together to form a loop for hanging the frame. Alternatively, the ends of the line 18 may be individually attached to a hook or similar structure for hanging the frame, or may simply be tied together tightly for displaying the frame without hanging.

Once the line 18 has been arranged through each of the desired holes 16 as described above, a display item 20 is positioned on the surface of the front side 12 of the panel 10 such that the corners 22*a*, 22*b*, 22*c*, 22*d* of the display item 20 are covered by the lengths of line 18 extending between each of the holes of each pair 16*a*, 16*b*, 16*c*, 16*d* of holes, as shown in FIG. 1. The line 18 is then pulled taut so that the display item 20 is held firmly in place, and the frame is then hung or otherwise set in place for display. If the user would like to change the photograph, etc. displayed in the frame, he can simply pull each length of line 18 on the front side 12 of the panel 10 between each hole of each pair 16*a*, 16*b*, 16*c*, 16*d* of holes in order to create slack in the line 18. The slack in the line 18 allows the user to remove the photograph, etc. and easily replace it with a new display item. The line 18 is then pulled taut again in order to hold the new item firmly in place for display.

Although the preferred method of displaying a photograph, etc. described above utilizes a panel 10 having eight holes 16, in combination with a generally rectangular display item 20, it should be understood by one skilled in the art that any display item 20 having at least three corners may be effectively utilized with the present invention. The number of holes 16 in the panel 10 (and, accordingly, the number of pairs of holes), along with the location of the holes 16, may be varied to correspond with display items of various shapes having various numbers of corners or edges that may be held in place using the line, as described herein.

Furthermore, although the preferred method of displaying a photograph, etc. described above identifies a specific order that is preferred for inserting the line 18 through the holes 16, it should be understood by one skilled in the art that the order may be changed and still fall within the scope of the present invention. In addition, not all of the holes 16 in the panel 10 must be utilized in order to fall within the scope of the present invention. For example, a rectangular display item 20 may be held in place in the frame by using only four of the eight holes 16 described above. For instance, the rectangular display item 20 could be held in place at opposite corners by using only the first pair 16*a* of holes and the third pair 16*c* of holes in order to hold two opposing corners 22*a*, 22*c* in place, or, alternatively, using only the second pair 16*b* of holes and the fourth pair 16*d* of holes in order to hold two opposing corners 22*b*, 22*d* in place.

In another alternative configuration, only four of the eight holes 16 may be utilized (or, alternatively, the panel 10 itself may comprise only four holes). In this embodiment, one hole of each of the pairs 16*a*, 16*b*, 16*c*, 16*d* is used, with each of the four holes 16 utilized corresponding to one corner 22*a*, 22*b*, 22*c*, 22*d* of the display item 20. One end of the line 18 is inserted through the back side 14 of the panel 10 into one of the holes of the first pair 16*a* of holes. Next, the same end of the line 18 is inserted through the front side 12 of the panel 10 into one of the holes of the second pair 16*b* of holes. The end of the line 18 is then inserted through the back side 14 of the panel 10 into one of the holes of the third pair 16*c*. Finally, the line 18 is inserted through the front side 12 of the panel 10 into one of the holes of the fourth pair 16*d* of holes. If this embodiment uses a panel 10 having eight holes 16, the holes 16 utilized should be selected based on the size and shape of the display item 20. Additionally, the holes 16 selected should preferably result in the lengths of line 18 on the front side 12 of the panel 10 having a generally vertical configuration relative to the desired configuration of the display item 20. Thus, two generally vertical lengths of line 18 extend along the front side 12 of the panel 10 between holes of the first 16*a* and second 16*b* pairs of holes and between holes of the third 16*c* and fourth 16*d* pairs of holes, respectively. The length of line 18 extending between holes of the first 16*a* and second 16*b* pairs of holes holds two corners 22*a*, 22*b* of the display item 20 in place. This length of line 18 extends along the left side of the display item 20 generally parallel to the left edge of the display item 20, thereby holding the entire left side of the display item 20 in place. Similarly, the length of line 18 extending between holes of the third 16*c* and fourth 16*d* pairs of holes holds the other two corners 22*c*, 22*d* of the display item 20 in place.

Figure 4:
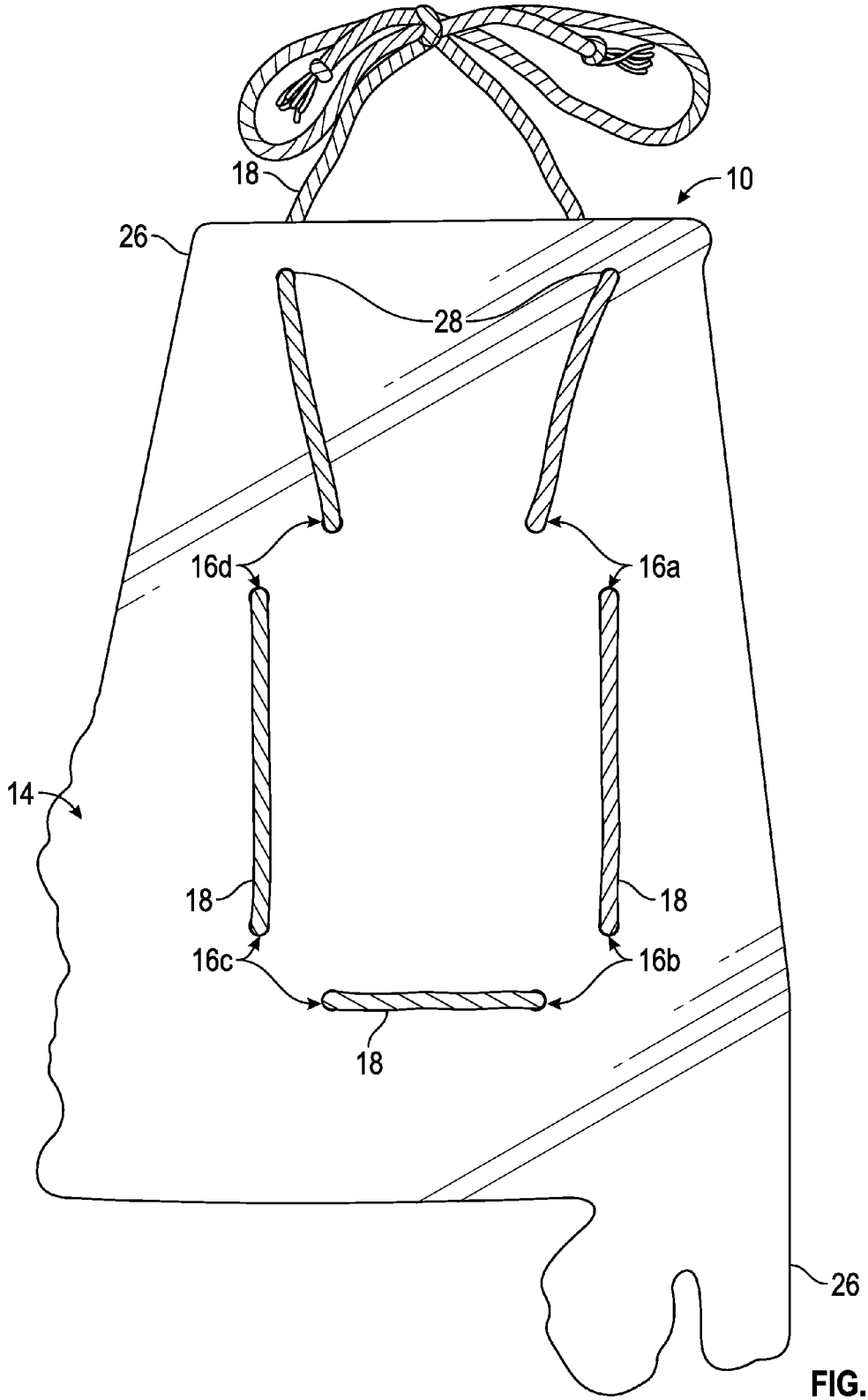
FIG. 4 is a rear elevational view of an apparatus embodying features of the present invention.

In an alternative embodiment, as illustrated in FIGS. 3-4, the panel 10 further comprises two additional holes 28 generally positioned near the end of the panel 10 that the user desires to be the top of the panel 10 when the frame is hanging. This embodiment is particularly useful when hanging the frame on a wall. In this embodiment, after the line 18 has been inserted through each of the desired holes 16 as described in any of the embodiments described above, each end of the line 18 is then inserted through each of the additional holes 28 so that the ends of the line 18 used for hanging the frame extend out of the front side 12 of the panel 10 (instead of the back side 14 of the panel 10, as is the case in the embodiment shown in FIGS. 1-2). Because the ends of the line 18 extend out of the front 12 side of the panel 10, the line 18 helps to keep the top end of the panel 10 positioned flush against the wall from which the frame is hanging.

Figure 5:
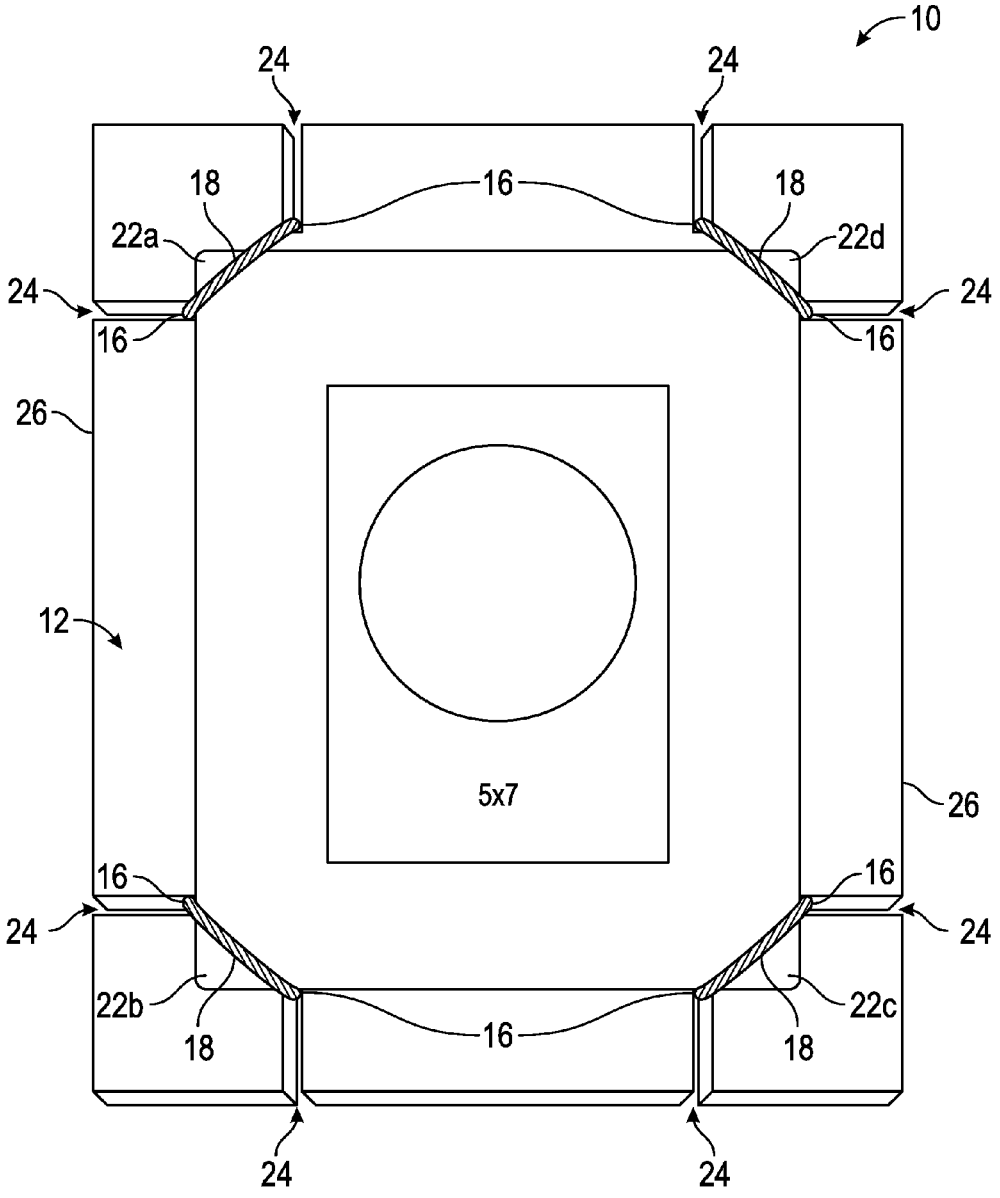
FIG. 5 is a front elevational view of an apparatus embodying features of the present invention.
Figure 6:
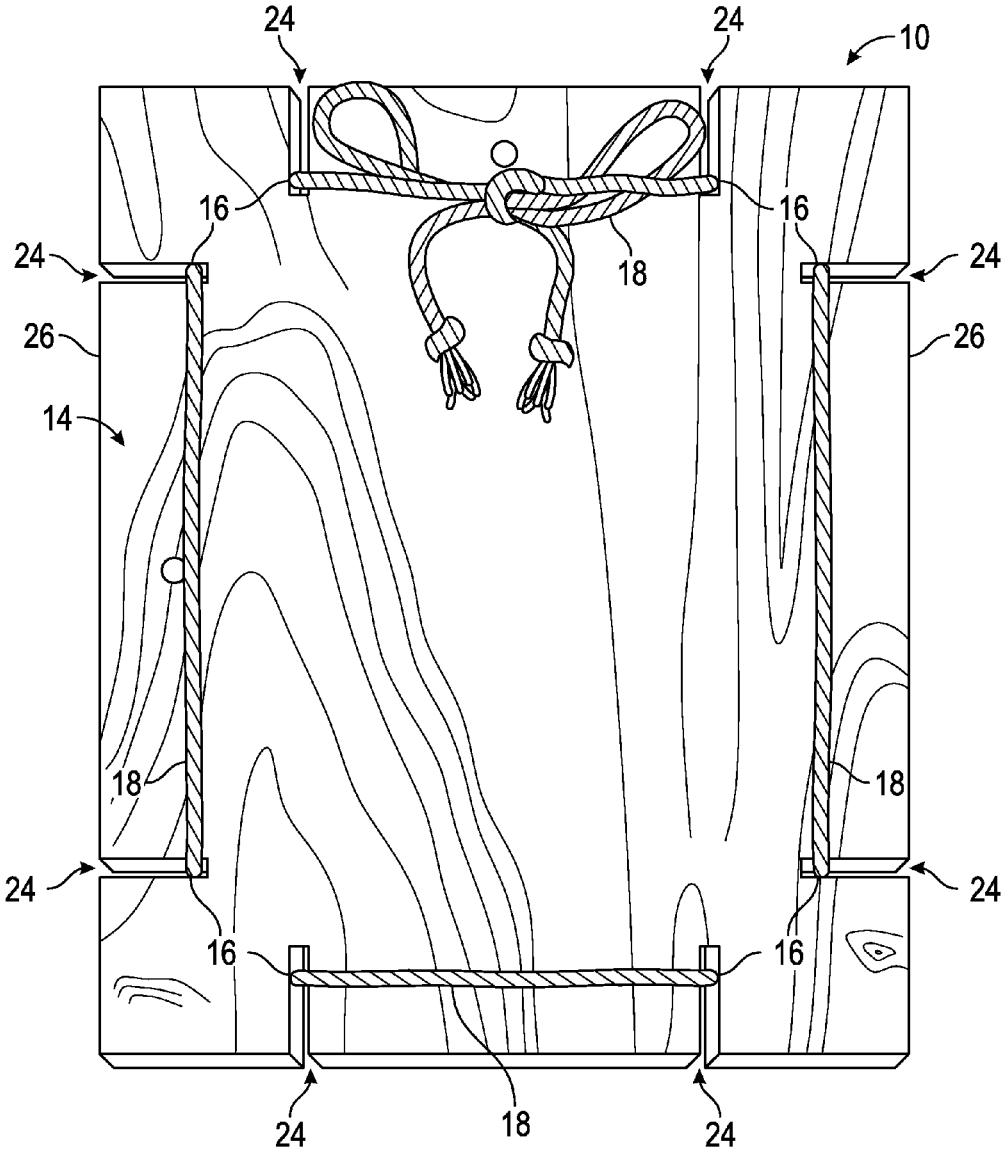
FIG. 6 is a rear elevational view of an apparatus embodying features of the present invention.

In another alternative embodiment, as illustrated in FIGS. 5-6, the panel 10 further comprises grooves 24 extending between each of the holes 16 in the panel 10 and the outer perimeter 26 of the panel 10. In a preferred embodiment, the grooves 24 are straight, as shown in FIG. 5, though they are not required to be straight. Additionally, in an embodiment comprising a rectangular panel 10 as shown in FIGS. 5-6, the grooves 24 are preferably perpendicular to the edge of the outer perimeter 26 of the panel 10, as illustrated in FIGS. 5-6. However, the grooves 24 may be configured at an angle and still fall within the scope of the present invention. This embodiment allows a user to easily configure the line 18 for securing a display item 20 without having to insert the end of the line 18 and then pull the line 18 through each of the holes 16 individually. Instead, the line 18 can be positioned in each of the holes 16 by sliding the line 18 into each of the grooves 24. This embodiment also allows the user to more easily create slack in the line 18 for changing the display item 20 to a new item, as discussed previously. However, in other respects, this embodiment functions in a similar manner as previously described embodiments. As in other embodiments, each of the corners 22*a*, 22*b*, 22*c*, 22*d* of the display item 20 are held in place by the lengths of line 18 extending along the surface of the front side 12 of the panel 10 between the holes 16. In the particular embodiment shown in FIG. 5, the display item 20 held in place is a piece of glass, under which a photograph, etc. is displayed. However, as discussed with respect to other embodiments, the line 18 may be configured to directly hold a photograph, drawing, painting, document, or similar visual representation in place without using a piece of glass.

It is understood that versions of the invention may come in different forms and embodiments. Additionally, it is understood that one of skill in the art would appreciate these various forms and embodiments as falling within the scope of the invention as disclosed herein.

What I claim as my invention is:

1. A method of displaying a representation such as a photograph, drawing, painting, or document, said method comprising the steps of:

a. providing a frame for displaying said representation, said frame comprising:
   i. a display item having at least three corners;
   ii. a substantially flat panel having a top, a front side, and a back side, said panel having a plurality of holes extending through the panel, some of said holes arranged in pairs, each pair corresponding to one corner of the display item such that a first hole of each pair is positioned on one side of the corner and a second hole of each pair is positioned on the opposite side of the same corner; said substantially flat panel having a pair of holes near the top of said panel and,
   iii. a single continuous length of line having a first end and a second end;
b. inserting the line through the front side of said panel through one of the holes near the top of said panel;
c. inserting the line through the back side of the panel through the first hole of a first pair of holes, and then inserting the line through the front side of the panel through the second hole of the first pair of holes, and then inserting the line through each of the remaining holes of each pair of holes in a same manner until the line is extended continuously through each hole of each pair of holes;
d. inserting the line through the back of the panel through the other of the top holes;
e. pulling the line taut such that any slack in the line is substantially removed; and,
f. positioning the display item on the front side of the panel such that each corner of the display item is positioned between a length of the line and the front side of the panel, thereby holding the display item in place against the panel,
g. securing the first end and the second end of the line together to hang the frame from a wall;
h. wherein the panel has at least ten holes.

* * * * *